US005422958A

United States Patent [19]

Wouch et al.

[11] Patent Number: 5,422,958

[45] Date of Patent: * Jun. 6, 1995

[54] PRINTING CYLINDER ENGRAVER CALIBRATION SYSTEM AND METHOD

[75] Inventors: Gerald Wouch, Lisle; Gary Procknow, Chicago; Gerald J. Bender, Park Forest; Richard R. Ewalt, Chicago, all of Ill.

[73] Assignee: R. R. Donnelley & Sons Company, Chicago, Ill.

[ * ] Notice: The portion of the term of this patent subsequent to Mar. 8, 2011 has been disclaimed.

[21] Appl. No.: 176,040

[22] Filed: Dec. 30, 1993

Related U.S. Application Data

[63] Continuation-in-part of Ser. No. 529,108, May 25, 1990, Pat. No. 5,293,426.

[51] Int. Cl.[6] ..... B41C 1/00

[52] U.S. Cl. ..... 382/141; 358/299; 101/401.1; 356/378

[58] Field of Search ..... 382/1, 8; 358/299; 356/394, 378, 379; 101/401.1

[56] References Cited

U.S. PATENT DOCUMENTS

| | | | |
|---|---|---|---|
| 3,808,878 | 5/1974 | Dini | 73/620 |
| 3,885,422 | 5/1975 | Dini | 73/622 |
| 3,931,570 | 1/1976 | George et al. | 324/228 |
| 4,003,311 | 1/1977 | Bardin | 156/626 |
| 4,072,928 | 2/1978 | Wilder | 382/8 |
| 4,408,883 | 10/1983 | Iwamoto et al. | 356/355 |
| 4,612,584 | 9/1986 | George et al. | 358/229 |
| 5,229,861 | 7/1993 | Nozaka | 358/229 |
| 5,293,426 | 3/1994 | Wouch et al. | 382/8 |

*Primary Examiner*—Jose L. Couso
*Assistant Examiner*—Matthew C. Bella
*Attorney, Agent, or Firm*—Arnold, White & Durkee

[57] ABSTRACT

A system for calibrating engraving heads used for engraving gravure printing cylinders determines a mean cell volume for cells forme din a test cut in a printing cylinder. The system of the present invention includes a procedure of cutting two or more test cuts in each printing cylinder. One of the test cuts is at the light end of the cylinder and the second is at he dark end. The morphological characteristics of a plurality of cells in each of the test cuts is measured, and morphological parameter values of the cell sin the test cut are computed. These morphological parameter values are compared with predetermined morphological parameter values, and each engraving head is adjusted in accordance with this comparison to cut the desired values within an acceptable tolerance band. The desired average values can be adjusted to take into account new inks, papers, batch variation in inks and papers, and diamond wear in the engraving head.

28 Claims, 2 Drawing Sheets

PRINTING CYLINDER ENGRAVER CALIBRATION SYSTEM AND METHOD

CROSS-REFERENCE TO RELATED APPLICATIONS

This is a Continuation-in-Part of U.S. patent application Ser. No. 07/529,108, filed May 25, 1990, now U.S. Pat. No. 5,293,426, the specification of which is herein incorporated by reference.

FIELD OF THE INVENTION

The calibration system of the present invention generally relates to a new and improved system and method for calibrating the engraving head of a machine used to engrave a gravure printing cylinder or a similar printing member; and to a new and improved system and method for rapidly measuring morphological features of up to all individual cells in a test cut in a gravure printing cylinder and computing the average values and other statistical measures of those cells in order to calibrate an engraving head.

DESCRIPTION OF THE PRIOR ART

Gravure printing is done on presses using printing images engraved on the surface of a cylinder. Consequently, the printing plates are cylindrical and are engraved to create cells or depressions in the printing areas. To print using these cylinders (or surfaces), the cells or depressions are filled with ink, and a doctor blade removes excess ink from the nonprinting areas. These cells or depressions are engraved into a gravure cylinder by an engraving head of an engraver or engraving machine such as a Helio-Klischograph manufactured by Dr. Ing. Rudolf Hell GmbH. The engraving head includes a diamond stylus for a cutting tool.

Prior to engraving a gravure cylinder, each engraving head of the engraver is calibrated. Calibration is performed by engraving selected tone steps called test cuts on the gravure cylinder. Each test cut is composed of a collection of preferably identical cells. Typically, at least two test cuts are made before an image is engraved onto the gravure cylinder. Normally, one test cut is engraved at the light end of the image which is a tone step corresponding to an optical density of about 0.05 units. A second test cut is normally made at the dark end or shadows of the image and is a tone step corresponding to a density of about 1.65 units. Tests cuts are not usually made in the midtone areas which normally occur at an optical density of approximately 0.50 units.

The typical practice in the prior art to calibrate an engraving head involved an operator choosing a single cell out of an engraved test cut, and measuring a morphological parameter of that cell with an optical microscope. Due to the time and effort required to manually measure a cell parameter such as width, which requires careful and laborious focusing with a focusing mechanism calibrated to correspond to a distance measurement, only a single cell would be measured from a test cut. A one-time adjustment would then be made to the engraving head, based on the measured parameter of the cell chosen from the test cut, designed to result in a cell with the desired morphological characteristics. Again, due to constraints imposed by time and practical convenience, the operator would usually not make a confirming test cut to determine whether or not a cell with the desired morphological parameter was actually produced after the calibration adjustment. This general procedure would then be performed for each of the highlight and shadow steps for each engraving head.

There are several features of this procedure that result in error and a resultant incorrect calibration. For example, this procedure depends on an arbitrary selection of a single cell in the test cut, and it is assumed that this single cell is representative of the size, shape, and volume of all of the cells in the test cut. Moreover, this procedure assumes that the engraving head, which uses a diamond stylus to cut each cell, cuts the same size cell when supplied with a consistent control voltage from the control system of the engraving machine. The control voltage supplied to the engraving head, in theory, determines the morphological characteristics of the cell, and each value supplied corresponds to a positive density value on the printed image resulting from cells cut with that control voltage being supplied to the engraving head.

It has been found that the fundamental assumptions behind this single-step calibration practice are incorrect. It has been determined that the cells in a test cut can differ significantly from each other in their morphological characteristics. By selecting only one cell there is a built-in error since a single cell is seldom representative of all of the cells in the test cut. It has been further determined that by only measuring a single morphological parameter, such as the width, of a single cell, the volume of the cells cannot be accurately determined. The result of these errors and miscalculations has been the inconsistent appearance of the printing produced by cylinders engraved by machines calibrated by these methods, along with excessive use of ink.

This calibration procedure is also unable to take into account short-term and long-term variations in the engraving mechanism. Over the short term, there are variations in the size of the cells cut by the engraver due to the inability of the engraver to make an identical cut each and every time. Long term variations are experienced as the diamond stylus of the engraver inevitably wears through continued use.

SUMMARY OF THE INVENTION

The present invention relates to a method for calibrating an engraving head of an engraver which engraves images on a printing member such as a gravure printing cylinder, and to the system for calibrating the engraving head. The method includes cutting a plurality of cells in at least one test cut in the printing member or cylinder. An optical image of up to all individual cells in the test cut(s) is obtained through the use of a high resolution microscope focused on the printing member. The optical image is converted into electrical signals that are processed to measure the length, width, and face area of a statistically-determined number of cells from the test cut. These measured values are used to a calculate morphological parameter value or values such as the mean average cell width, length, depth, face area and volume per unit area. The calculated morphological parameter value is then compared with a standard or desired value (a predetermined morphological parameter value), and the engraving head is adjusted or calibrated in accordance with any variation between the calculated and the predetermined value. Once the calibration is completed, the printing member or cylinder is engraved using the calibrated engraving head.

BRIEF DESCRIPTION OF THE DRAWINGS

Other objects and advantages of the invention will become apparent upon reading the following detailed description and upon reference to the accompanying drawings, in which.

DETAILED DESCRIPTION OF PREFERRED EMBODIMENT

Figures 1, 1A:
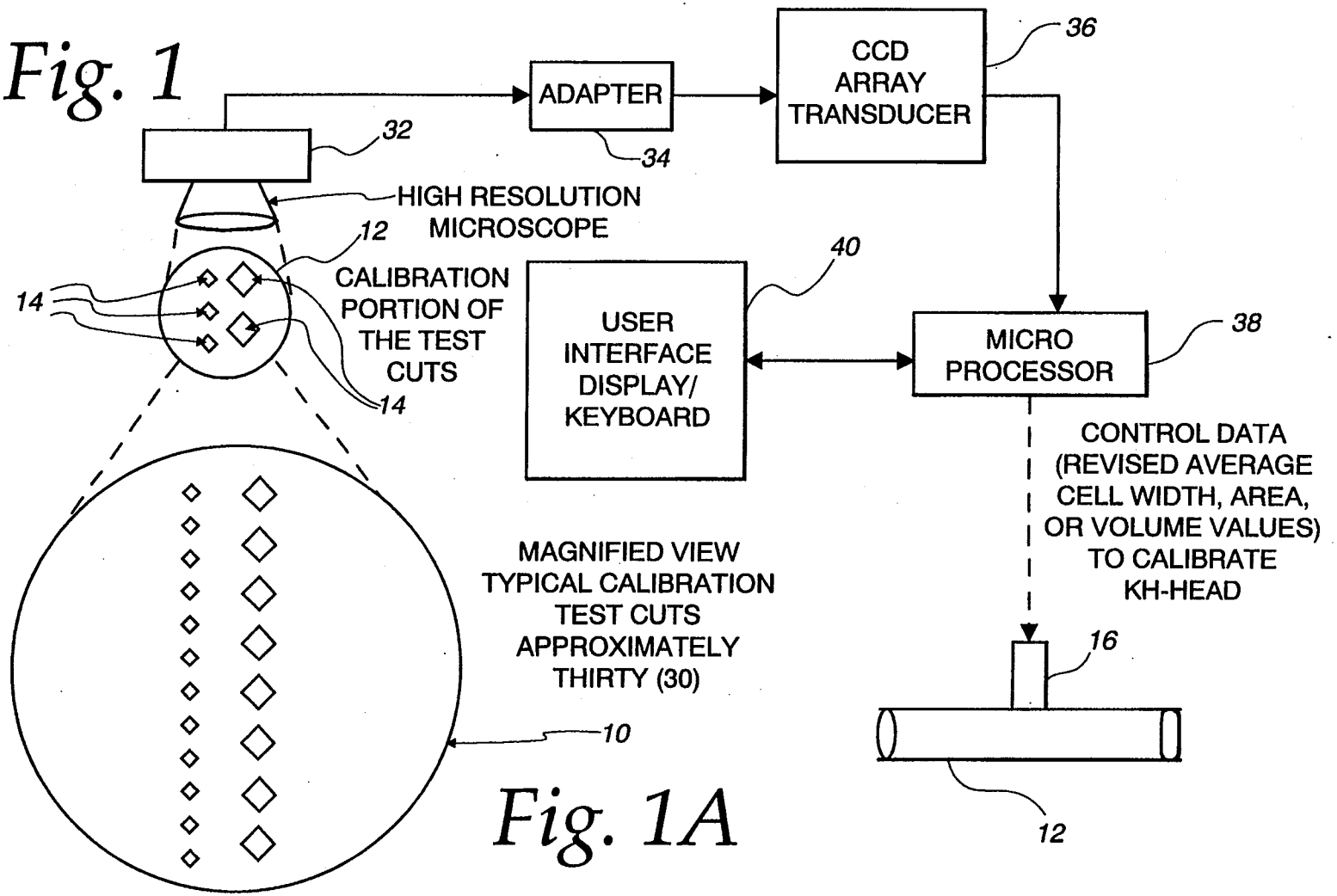
FIG. 1 is a schematic illustration of a printing cylinder engraver calibration system constructed in accordance with the principles of the present invention.

The present invention relates to electronically controlled engraving of gravure printing cylinders and, more specifically, to the calibration of an engraver in an engraving machine used to engrave gravure cylinders or other printing members.

An engraving machine typically includes a scanning head for scanning original material that is to be engraved on a gravure cylinder. Original material may alternately be directly input electronically from a digital rendering of the image and/or text to be printed, thus obviating the need for a scanning step. The scanning head utilized in the practice of the method of the present invention serves primarily the same function as the densitometers used in prior art methods for analyzing either the original item to be printed, or its film image. The data gathered by the scanning head ultimately serves to control the volume of each cell cut in the gravure cylinder in relation to the scanned optical information. The scanning head generates a signal that is converted to a digital value corresponding to each available tone. When input is supplied from a digital file, the digital value used to control the cutting of cells in the cylinder is supplied directly from the file. This digital value is input to the engraving machine and converted to an output voltage that drives the engraving head 16 of the engraving machine. A given output voltage corresponding to a digital value from either a scanned image or from a file will produce a cell 14 of a given width, area, and volume.

Generally, once a gravure cylinder 12 has been copper plated and finished, and prior to engraving an image on the cylinder 12, one or more test cuts 10 are engraved in the cylinder 12 by engraving heads 16 of an engraving machine such as a Helio-Klischograph engraving machine manufactured by Dr. Ing. Rudolf Hell GmbH. Each test cut 10 is intended to reproduce a specific tone value on resulting printed copy as measured by a device such as an optical reflectance densitometer.

Each test cut 10 (see FIG. 1) engraved in the gravure cylinder 12 is composed of a collection of cells 14 which are intended to print the same optical density time after time. Typically, a test cut will contain a plurality of such cells, with a typical average of thirty cells. The vibrating diamond stylus of the engraving head 16 cuts into the copper surface of a gravure printing cylinder 12 to form a cell 14 in the shape of an inverted pyramid (see FIG. 3). This cell shape ensures consistent and optimal ink release even when printing on smooth or non-porous surfaces. Typically, two test cuts 10 are made by each engraving head 16 of the Helio-Klischograph. Before the image to be printed is engraved onto a cylinder 12, one test cut 10 is normally engraved at the light end of the image which is a tone step corresponding to an optical density of about 0.05 units. A second test cut is made at the dark end which is a tone step corresponding to a density of about 1.65 units.

According to prior art methods, calibration of an engraving head 16 was accomplished by an operator of the engraving machine selecting a single, hopefully representative, cell 14 from the test cut 10, and manually measuring a parameter such as the length or width of that cell 14 with an optical microscope. The engraving head 16 was then adjusted to cut a cell 14 of a desired parameter if that desired parameter varied from the measured parameter. This technique was founded on the assumption that the engraving head 16 which uses a diamond stylus to cut each cell 14, always cuts a cell 14 of the same size, shape and volume when the engraving head 16 receives a signal of the same control voltage as determined by a digital control value. This control voltage, in theory, determines the morphological characteristics of the cell cut.

The present invention is based on discovery that the assumption that an engraving head 16 always cuts the same size cell when supplied with the same digital control value is incorrect. It has been found that the same digital value resulting in a control voltage supplied to an engraving head 16 does not result in the same size cell 14 to within an acceptable tolerance. An acceptable tolerance in print density for a tone step cut with a specified digital control value is to within plus or minus 0.05 density units of the positive density corresponding to that digital value in the shadows of the resulting printed image. A corresponding tolerance level of within plus or minus 0.02 density units is acceptable for the highlights. It has been discovered that tone step cuts with the same supplied digital control value vary by as much as plus or minus 0.15 density units or more when cut successively by the same engraving head 16.

It has been determined that the print density corresponding to a specific average equivalent cell volume per unit area is typically within a preferred tolerance band. This discovery is complicated, however, by the fact that the same digital control value does not always produce a tone step with the same average equivalent cell volume per unit area. Once this problem is overcome, however, consistent tone reproduction can be achieved.

The solution to this problem is to make the same digital control value produce the same average equivalent cell volume per unit area when engraving a specific tone step. The average equivalent cell volume per unit area is computed by averaging measurements of a plurality of the individual cells 14 within each test cut. In contrast to the procedures followed in the past, under the procedure of the present invention, up to all of the cells 14 in a test cut 10 can be measured and statistically analyzed to calibrate the engraving head 16. In the past, a single cell was arbitrarily selected and measured, and this cell was assumed to be representative of all the cells in the test cut. Whereas cell volume gives the best calibration, average cell width, or area can be used as the selected morphological parameter to improve klischograph calibration to a lesser, but still improved, degree.

Figure 2:
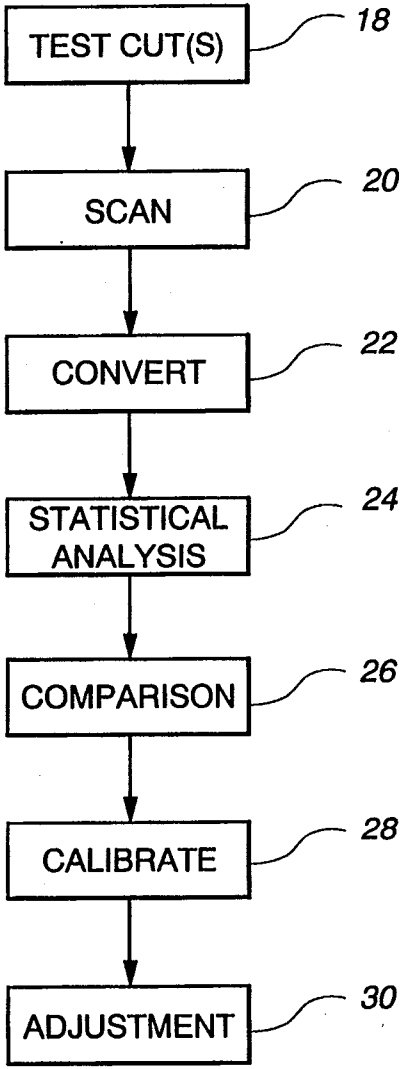
FIG. 2 is a flow diagram of the steps taken in accordance with the method of the present invention.

The procedure or method of calibrating an engraving head 16 of the present invention is set forth in the flow diagram illustrated in FIG. 2. To calibrate each engraving head 16 of an engraving machine to engrave the same tone step to within a selected tolerance, one or more test cuts must be cut in the cylinder 12. This is depicted in the test cut step 18 of FIG. 2. One of the test cuts should be in the light end to produce an optical density of about 0.05 units when printed on paper, and the other test cut should be in the dark end to produce an optical density of about 1.65 units when printed on paper. Additional test cuts in the midtones can be included to further improve calibration. This is made possible by the speed of the measurement steps of the present invention which permits the measurement of a plurality of cells in test cuts within a practically acceptable time period.

The next step, depicted in FIG. 2, is to scan the test cut 10 and measure morphological characteristics such as width w, length 1, and face area a, of individual cells in the test cut. Preferably, the cells cut at the start of the cutting process when the machine is not at equilibrium, and at the finish of the cutting process when the machine is also not at equilibrium, are either excluded from this scan, or the measurements derived from these non-equilibrium cells are deleted from the set of measurements subject to subsequent statistical processing.

There are situations wherein it may not be possible or expedient to measure all of the cells to obtain a mean value for a selected parameter, e.g., the mean value of the area of the cells selected by some criterion. One example would be a situation wherein some of the cells in a test cut are outside the operator-established tolerances. Another would be when the number of cells to be measured is very large, e.g. there may be fifty to a hundred or more cells in a specific tone step as opposed to thirty in a typical calibration test cut. Statistical estimation of the mean value of a selected parameter, e.g. cell area, can then be used to obtain an estimate of the mean value within prescribed confidence limits. The techniques to do this are well known and can be found in standard textbooks on statistics (see, for example, Freund, J. E., "Modem Elementary Statistics," Prentice Hall Inc. 1979, Chapter 10). These techniques do not constitute a patentable aspect of the present invention, but they may be applied to obtain acceptable approximations of the mean value of the selected parameter that would be obtained my measurement of all the cells in a test cut.

There is a procedure used to measure the "balance" of an engraved cylinder, which is defined herein by the consistency of a selected set of tone steps engraved by several individual engraving heads across the cylinder. Variation in copper hardness, diamond stylus wear, and diamond stylus mount in the engraving heads may produce significant differences in the mean value of cell areas in the tone steps across the cylinder. If so, the cylinder might have to be re-engraved. It should be noted that proper calibration procedures such as described herein can take into account such factors as hardness by adjusting the mean cell areas in the test cuts across the cylinder to fall within prescribed tolerance limits. However, it is common practice to perform balancing measurements on test cylinders at measured time intervals, e.g. every week. The tone steps in the test cylinders cut in this context may contain as many as fifty or more cells.

Because of the large number of cells involved in a cylinder balancing test, past procedure has been to take the test cylinder to a proof press and print with it. The densities of corresponding tone steps across the cylinder would then be compared to see if the printing was consistent across the cylinder. This technique has been described in references such as U.S. Pat. No. 4,003,311 to Bardin. The method of the present invention, coupled with statistical estimation of the mean value of the selected morphological parameter, e.g. cell area, eliminates the need for printing on a proof press. Using the method of the present invention, the balancing test can now be done much faster in the cylinder engraving room, and is not subject to inconsistencies arising from the subsequent printing process which have nothing to do with cylinder "balance". It can also be done more frequently, more consistently, and in less time.

If all the cells in a tone step constitute the "population", then a measurement of the areas (or any other suitable morphological parameter) of all the cells in the population will enable the mean value of the cell area to be calculated for the entire population. This is referred to as the population mean, $m_p$. When a sample (or subset) of cells is selected (e.g., 5 out of the 30 or more cells in the test cut), the selected cells are referred to as a sample of size 5 out of 30, and the mean of the sample is called the sample mean, $m_s$. In order for calibration methods such as those of the present invention to produce acceptable results in terms of acceptably consistent images, it is required that $m_s$ be a good estimate of $m_p$, that is, $m_s$ must be statistically equivalent to $m_p$.

Using statistical procedures such as those set out in Freund (1979), it is possible to determine the minimum sample size (s) required out of a population (p) of cells (tone steps) to estimate the population mean ($m_p$) to within a prescribed error, with a calculated degree of confidence, e.g., to within 5% with a statistically significant 95 or 99% degree of confidence.

According to generally-accepted principles of statistics, as set forth in the central limit theorem, the sampling distribution of the mean, for a large enough sample, can be approximated closely with a normal curve. Hence, it is possible to assert with probability $1-\alpha$ that a sample mean, $m_s$, will differ from the population mean, $m_p$, by less than $z_{\alpha/2}$ standard errors of the mean. The value $z_{\alpha/2}$ corresponds to an area under the standard normal curve that equals $\alpha/2$. Because the standard error of the mean is $$\sigma_x = \frac{\sigma}{\sqrt{n}}$$

for random samples of size n from infinite or very large populations, the probability is $1-\alpha$ that $m_s$ will differ from $m_p$ by less than $$z_{\alpha/2} \cdot \frac{\sigma}{\sqrt{n}},$$

and since $m_s - m_p$ is the error we make when we use $m_s$ as an estimate of $m_p$, the probability is $1-\alpha$ that the size of this error will be less than $$E = z_{\alpha/2} \cdot \frac{\sigma}{\sqrt{n}}.$$

The two values most widely used for $1-\alpha$ are 0.95 and 0.99. From existing tabulations (see, e.g., Freund (1979)), the corresponding value of $z_{\alpha/2}$ is 1.96 for $z_{0.025}$ ($1-\alpha=0.95$), and 2.58 for $z_{0.005}$ ($1-=0.99$).

To be able to judge the size of the error we might make when $m_s$ is used as an estimate of $m_p$, it is necessary to know $\sigma$, the population standard deviation. Since this is not the case in most practical situations, it is necessary to replace $\sigma$ with an estimate, usually the sample standard deviation s. In general, this is considered to be reasonable provided the sample size, n, is sufficiently large, generally 30 or more.

The formula for the maximum possible error within a specified probability can also be used to determine the sample size needed to attain a desired degree of precision. Using the mean of a random sample to estimate the mean of a population, with a probability $1-\alpha$ that the error of this estimate is less than prescribed quantity E, the above expression for E is rewritten and solved for n as expressed below:

$$n = \left[\frac{z_{\alpha/2} \cdot \sigma}{E}\right]^2.$$

As can be seen from the above formula, this method can be used only when the value of the standard deviation of the population whose mean we trying to estimate is known, at least approximately.

The error that arises from using a sample mean to estimate the mean of a population is given by the difference $m_s - m_p$. This, combined with the fact that (with probability $1-\alpha$) the magnitude of this error is less than $$z_{\alpha/2} \cdot \frac{\sigma}{\sqrt{n}},$$

leads to the following inequality:

$$-z_{\alpha/2} \cdot \frac{\sigma}{\sqrt{n}} < m_s - m_p < z_{\alpha/2} \cdot \frac{\sigma}{\sqrt{n}}.$$

This inequality can be rewritten as:

$$m_s - z_{\alpha/2} \cdot \frac{\sigma}{\sqrt{n}} < m_p < m_s + z_{\alpha/2} \cdot \frac{\sigma}{\sqrt{n}}.$$

It is possible to assert with probability $1-\alpha$ that the inequality is satisfied for any given sample. In other words, it is possible to assert with probability $1-\alpha$ that the interval from $$m_s - z_{\alpha/2} \cdot \frac{\sigma}{\sqrt{n}} \text{ to } m_s + z_{\alpha/2} \cdot \frac{\sigma}{\sqrt{n}}$$

actually contains the estimated population mean. This interval is called a confidence interval, its endpoints are called confidence limits, and the probability $1-\alpha$ is called the degree of confidence. As before, the values most commonly used for $1-\alpha$ are 0.95 and 0.99, and the corresponding values of $z_{\alpha/2}$ are 1.96 and 2.58, respectively. In contrast to point estimates, estimates given in the form of confidence intervals are called interval estimates. When $\sigma$ is unknown and n is at least 30, we replace $\sigma$ by the sample standard deviation s.

When the number of cells is small, e.g. ten or less, as in the portion of the test cut used for calibration, it may still be impractical or undesirable to measure all of the cells in the test cut because, for example, one or more cells may be outside the operator-established tolerances. In that case, recognized small sample statistical procedures may be used to estimate the mean value of the selected parameter, e.g. cell area. Such procedures are described in any standard statistics textbook (see, for example, Freund, 1979, Chapter 10).

The discussion above has been based on the assumptions: (1) that the sample size is large enough to treat the sampling distribution of the mean as if it were a normal distribution; and (2) that (when necessary) $\sigma$ can be replaced with s in the formula for the standard error of the mean. To develop a corresponding theory that applies also to small samples ($n < 30$), it is necessary to assume that the population sampled has roughly the shape of a normal distribution. Given that assumption, methods for estimating the mean of a small sample can be based on the following $$t = \frac{m_s - m_p}{\frac{s}{\sqrt{n}}}.$$

More specifically, this quantity is referred to as the Student's t distribution, as it was first investigated by W. S. Gosset, who published his writings under the pen name "Student." The shape of this distribution is considered to be very much like that of a normal distribution, and it is symmetrical with zero mean. The exact shape of the t distribution depends on the quantity $n-1$, the sample size less one, called the number of degrees of freedom.

For the standard normal distribution, we defined $z_{\alpha/2}$ in such a way that the area under the curve to its right equals $\alpha/2$, and hence, the area under the curve between $-z_{\alpha/2}$ and $z_{\alpha/2}$ equals $1-\alpha$. The corresponding values for the t distribution are $-t_{\alpha/2}$ and $t_{\alpha/2}$. These values, which depend on $n-1$, the number of degrees of freedom, can be obtained from published tabulations (see, e.g., Freund (1979)). Such tabulations contain values for $t_{0.025}$ and $t_{0.005}$ for 1 through 29 degrees of freedom. These tabulated values reflect the fact that $t_{0.025}$ approaches 1.96 and $t_{0.005}$ approaches 2.58 (the corresponding values for the standard normal distribution) as the number of degrees of freedom approaches that for the minimum sample size upon which the above discussion of estimation of means for large samples was based (i.e., $n \geqq 30$).

Since the t distribution, like the standard normal distribution, is symmetrical about its mean ($m_p=0$), it is possible to duplicate the reasoning applied above with respect to larger sample sizes. The following result for the $1-\alpha$ small-sample confidence interval for $m_p$ is given as follows:

$$m_s - t_{\alpha/2} \cdot \frac{s}{\sqrt{n}} < m_p < m_s + t_{\alpha/2} \cdot \frac{s}{\sqrt{n}}.$$

The only difference between this confidence interval formula and the large-sample formula (with s substituted for $\sigma$) is that $t_{\alpha/2}$ takes the place of $z_{\alpha/2}$. Thus, the method provided above for determining the maximum error at probability $1-\alpha$ from using a sample mean to estimate the mean of a population can easily be adapted to small samples ($n<30$), provided that the sampled population approximates a normal distribution. Likewise, it is also possible to calculate the minimum sample size n needed to attain a sample mean that approximates the corresponding population mean within a specified level of error.

Using the assumption that even the small population of cells from a test cut is normally distributed, the "Student's t Distribution" can be used to determine the degree of confidence to which an estimate of the mean value from a small sample, ($m_s$) falls within a selected error range of the population mean value. For example, one may find that only 6 cells out of the thirty in the test cut need be measured.

Once the cells of the test cut are scanned, the scanned images are then converted into electrical signals in step 22. These electrical signals representing captured data are used in the statistical analysis in step 24 to compute a morphological parameter value such as the average cell volume per unit area for each of the test cuts. The calculated average cell width, area, or volume per unit area is then compared in step 26 with a predetermined morphological parameter value, and the engraving head 16 is calibrated in step 28 in accordance with the variance between the calculated value and the predetermined value. The predetermined morphological parameter value can be adjusted in step 30 to take into account new inks, new paper, batch variations in inks and paper, or diamond stylus wear.

The steps of the flow chart of FIG. 2 are performed by the image analyzer system illustrated in FIG. 1. Specifically, once the test cut 10 has been made and the individual cells 14 engraved, all of the cells 14 in the field of view are rapidly measured by a cylinder-sitting high resolution microscope 32 or other kind of microscope, focused on the desired test cut, e.g., mounted on an overhanging arm. The microscope 32 is fitted with an adapter 34 for connection to a charged coupled device (CCD) array 36 which converts the optical image seen by the microscope 32 into electrical signals.

Data in the form of electrical signals are then transmitted to a microprocessor 38 that is controlled by a user interface 40 which may be a display terminal and keyboard. A statistical analysis of the data, as described above, to compute a morphological parameter value is performed by the microprocessor 38. A comparison of the average cell width, area, or volume per unit area with a predetermined value is also performed by the microprocessor 38. Once this comparison is completed, adjustments are made to the amplifier that controls the engraving head 16 to calibrate the engraving head 16. Any adjustments to each calibrated head 16 takes into account different papers, batch variations in inks and papers, or diamond wear can be accomplished through the data obtained command from the user interface 40.

As the diamond stylus of an engraving head is used to engrave cylinders, the diamond tip will wear away to the point where the present system may not be able to compensate by, for example, increasing the cell area. The diamond stylus may also become physically damaged, e.g. it may chip. In either case, wear or damage, the new klischograph calibration system can compensate for these by adjusting mean cell areas in test cuts to be within a small tolerance window. Because of its unique capability to view the captured image from which the measurements of parameters are obtained, cell shapes may be monitored. A worn or chipped diamond may not cut a symmetrical cell or may not cut the desired compressed, elongated, or normal shape.

A morphological parameter, which most commercially available image analyzers can measure is the "shape factor," which is a measure of the shape of a captured object in a captured image. Ideal shape factors can be stored for comparison purposes in the microprocessor memory. When deviations from the desired cell shape exceed a certain prescribed limit, it can be presumed that the diamond is either worn or damaged to the point where removal and repair is necessary. The klischograph calibration system of the present invention, which includes an image analyzer, thus has the additional capability of comparing shapes and also measuring circularity. The system can thus be used to monitor diamond stylus condition at all times. This allows adjustments with the midtone corrections which will assist in determining the usefulness of a given diamond.

One image analyzer system that can be used for the charged coupled device array 36, the microprocessor 38 and the related software is an image analyzer provided by Joyce-Loebl of Garden City, N.Y. Other systems and software can be used to accomplish the same statistical analysis and comparisons.

Figure 3:
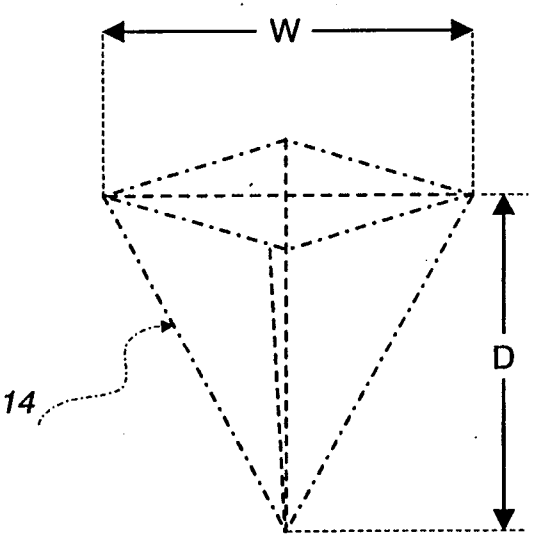
FIG. 3 is an illustration of a cell formed in a test cut that is measured by the system of the present invention.

The calculation of cell volume performed by the microprocessor 38 can be based on one of several theoretical approaches. One theoretical approach is based on a formula developed by the Gravure Research Institute. This formula is as follows:

$$\frac{w}{d} = \tan\left(\frac{1}{2}\alpha_c\right)$$

where w is the width of the cell 14 illustrated in FIG. 3, d is the depth of the cell 14 in FIG. 3, and $\alpha_c$ is the cutting angle of the stylus of the engraver. The width w can be measured using the high resolution microscope 32, and the depth d can be calculated using the above formula.

This information can then be used in a formula for determining the volume of the cell based on the assumption that the volume of a cell is substantially the volume of a pyramid. This volume may be calculated in accordance with the following formula:

$$V_c = \frac{1}{3} A_m d_c$$

where $V_c$ is the volume of a pyramid or cone, $A_m$, is the area of the face of the test cell 14 measured by the high resolution microscope 32, and $d_c$ is the depth of the cell 14 as calculated by the first formula.

Since the volumes of the cells 14 can be calculated using the image analyzer of FIG. 1 and the above formulas, it is possible to plot print density versus mean cell volume curves. From these curves, it was determined that regardless of what engraving machine or engraving head is used, if the same mean cell volume could be maintained, it is possible to get the same print density every time within the allowed or selected tolerance band.

Using the image analyzer of FIG. 1, it is also possible to plot a histogram of the number of cells vs. cell volume. From these histograms it was found that some cells 14 were of low volume, others were of large volume, and still others were in the middle between the low volume and the large volume. In the past, an operator of an engraving machine would select only one cell in calibrating the engraving head 16. If a cell of a small volume was selected, the engraving head 16 would be adjusted to make cells with a larger volume. If the selected cell was not truly representative of all the cells in the test cut, the adjustment would be incorrect resulting in poor print quality and/or unnecessary consumption of ink.

Using the system of the present invention, however, the mean average cell volume per unit area is calculated based on either the entire population of cells in the list cut or a statistically-determined sample of those cells. This calculation takes into account all the variations in cell volume. The mean cell volume per unit area more nearly approximates the actual cell volumes of the cells in the test cut, resulting in improved print quality and reduced consumption of ink. Calculating the average mean value per unit area will also compensate for long term variations as the diamond stylus wears. Values other than volume can be used to calibrate the engraver, e.g. cell width, and cell area. It has been found that these values may also be averaged to improve the calibration, although to a lesser degree.

Prior to the current invention there was no recognition of the advantage of measuring the width, area, or volume of more than one cell 14 or measuring more than one dimension of each cell. By following the procedure of the present invention, increased accuracy in calibrating the engraving head 16, improved print quality and proper consumption of ink are possible.

Because the image analyzer component of the klischograph calibration system of the present invention contains a microprocessor with substantial memory storage capability, it is possible to archive past calibrations. Diamond condition over a period of time can also be archived. The calibration control system can thus function as a Statistical Process Control (SPC) system to monitor klischograph performance. It can also function as a Statistical Quality Control (SQC) system to monitor the quality of engraved cylinders without the need to print in a proof press. Because this level of control of the cylinder-making process can be achieved, the pressroom can be freed to focus upon other factors, such as those related to ink and paper, not related to the cylinder engraving process, which can affect the printing quality.

Because numerous modifications and variations in the practice of the present invention are expected to occur to those skilled in the art, only such limitations as appear in the appended claims should be placed thereon.

What is claimed is:

1. A method for calibrating an engraving mechanism of an engraver used to engrave a printing member, comprising:

cutting a multitude of cells in at least one test cut in the printing member;

making an optical image of the multitude of cells in the at least one test cut;

transducing the optical image into electrical signals;

digitally processing the electrical signals representing the optical image of the multitude of cells in the test cut to measure at least one morphological characteristic of each cell in a plurality of cells imaged from the test cut, said plurality of cells sufficient in number to provide a morphological parameter value statistically equivalent to an average morphological parameter value calculated from a measurement of a morphological characteristic of each individual cell in the multitude of cells, said cells having been cut while the engraver is operating at equilibrium conditions;

using said measured morphological characteristics to calculate the morphological parameter value for said test cut;

comparing the calculated morphological parameter value with a pre-determined morphological parameter value; and adjusting the engraving mechanism of the engraver in accordance with any variance between said calculated morphological parameter value and said predetermined morphological parameter value.

2. The method for calibrating the engraving mechanism of an engraver used to engrave a printing member set forth in claim 1, wherein said step of adjusting the engraving mechanism of the engraver includes adjusting said engraving mechanism to cut the cells so that said any variance between said calculated morphological parameter value and said predetermined morphological parameter value falls within a predetermined tolerance band.

3. The method for calibrating the engraving mechanism of an engraver used to engrave a printing member set forth in claim 1 further comprising the step of adjusting the pre-determined morphological parameter value to account for different inks.

4. The method for calibrating the engraving mechanism of an engraver used to engrave a printing member set forth in claim 1 further comprising the step of adjusting the pre-determined morphological parameter value to account for wear of the engraving mechanism.

5. The method for calibrating the engraving mechanism of an engraver used to engrave a printing member set forth in claim 1, wherein said morphological parameter value is an average cell width.

6. The method for calibrating the engraving mechanism of an engraver used to engrave a printing member set forth in claim 1, wherein said morphological parameter value is an average cell area.

7. The method for calibrating the engraving mechanism of an engraver used to engrave a printing member set forth in claim 1, wherein said morphological parameter value is a volume per unit area.

8. The method for calibrating the engraving mechanism of an engraver used to engrave a printing member set forth in claim 1, wherein said morphological parameter value is a shape factor.

9. A system for calibrating an engraving mechanism of an engraver used to engrave a printing member, comprising:

a viewer mounted in viewing relationship on the printing member for viewing a plurality of cells in a test cut made in the printing member, said plurality of cells sufficient in number to provide a morphological parameter value statistically equivalent to an average morphological parameter value calculated from a measurement of a morphological characteristic of each individual cell in the test cut, and wherein said plurality of cells has been cut while the engraver is operating at equilibrium conditions;

a converter coupled to said viewer for converting an optical image viewed by said viewer into electrical signals; and an image analyzer coupled to said converter for employing said electrical signals to measure at least one morphological characteristic of each cell in the plurality of cells in the test cut, to calculate the morphological parameter value for the plurality of cells, and to compare the calculated morphological parameter value with a pre-determined morphological parameter value; and means for adjusting said engraving mechanism in response to a variance between said calculated morphological parameter value and said pre-determined morphological parameter value.

10. The system for calibrating the engraving mechanism of an engraver used to engrave a printing member as claimed in claim 9 wherein said viewer is a high resolution microscope.

11. The system for calibrating the engraving mechanism of an engraver used to engrave a printing member as claimed in claim 9 wherein said converter comprises a charged couple device array.

12. The system for calibrating the engraving mechanism of an engraver used to engrave a printing member set forth in claim 9 wherein said morphological parameter value is an average cell width.

13. The system for calibrating the engraving mechanism of an engraver used to engrave a printing member set forth in claim 9 wherein said morphological parameter value is an average cell area.

14. The system for calibrating the engraving mechanism of an engraver used to engrave a printing member set forth in claim 9 wherein said morphological parameter value is a volume per unit area.

15. The system for calibrating the engraving mechanism of an engraver used to engrave a printing member set forth in claim 9 wherein said morphological parameter value is a shape factor.

16. A method for calibrating a printing member engraving element, comprising the steps of:

using the engraving element to engrave a multitude of cells in a test cut in a printing member;

obtaining an optical image of a plurality of cells in the multitude, said plurality of cells sufficient in number to provide a morphological parameter value statistically equivalent to an average morphological parameter value calculated from a measurement of a morphological characteristic of each individual cell in the multitude of cells, said cells having been cut while the engraver is operating at equilibrium conditions;

converting each optical image into electrical signals;

processing the electrical signals from the images of each cell to calculate the morphological parameter value for the plurality of cells imaged from the test cut;

comparing the calculated morphological parameter value with a pre-determined morphological parameter value; and adjusting said engraving element in accordance with any variance of said calculated morphological parameter value from said predetermined morphological parameter value.

17. The method for calibrating a printing member engraving element set forth in claim 16 wherein said step of obtaining an optical image of each cell includes measuring the dimensions of each cell.

18. The method for calibrating a printing member engraving element set forth in claim 16 further comprising the step of adjusting said engraving element to accommodate variations in paper, and batch variations in ink and paper.

19. The method for calibrating a printing member engraving element set forth in claim 16 wherein said morphological parameter value is an average cell width.

20. The method for calibrating a printing member engraving element set forth in claim 16 wherein said morphological parameter value is an average cell area.

21. The method for calibrating a printing member engraving element set forth in claim 16 wherein said morphological parameter value is a volume per unit area.

22. The method for calibrating a printing member engraving element set forth in claim 16 wherein said morphological parameter value is a shape factor.

23. A system for calibrating an engraving mechanism of an engraver used to engrave a printing member, comprising:

a viewer mounted in viewing relationship to the printing member for viewing a plurality of cells in a test cut made in the printing member, said plurality of cells sufficient in number to provide a morphological parameter value statistically equivalent to an average morphological parameter value calculated from a measurement of a morphological characteristic of each individual cell in the test cut, and wherein said cells have been cut while the engraver is operating at equilibrium conditions;

a converter coupled to said viewer for converting an optical image viewed by said viewer into electrical signals; and an image analyzer coupled to said converter for employing said electrical signals to measure at least one morphological characteristic of each cell in the plurality of cells in the test cut, to calculate a morphological parameter value for the plurality of cells in the test cut based on the measured morphological characteristics of the plurality of cells in the test cut, and to compare the calculated morphological parameter value with a pre-determined morphological parameter value; and means for adjusting said engraving mechanism in response to a variance between said calculated morphological parameter value and said pre-determined morphological parameter value.

24. The system for calibrating the engraving mechanism of an engraver used to engrave a printing member set forth in claim 23 wherein said morphological parameter value is an average cell width.

25. The method for calibrating the engraving mechanism of an engraver used to engrave a printing member set forth in claim 23 wherein said morphological parameter value is an average cell area.

26. The method for calibrating the engraving mechanism of an engraver used to engrave a printing member set forth in claim 23 wherein said morphological parameter value is a volume per unit area.

27. The method for calibrating the engraving mechanism of an engraver used to engrave a printing member set forth in claim 23 wherein said morphological parameter value is a shape factor.

28. A method for calibrating quality control characteristics of a printing member, comprising:

recording in a computer processor a pre-determined morphological characteristic for a test cut;

providing a multitude of cells in at least one test cut in the printing member, wherein each of said multitude of cells is characterized by at least one morphological characteristic;

using an optical imaging device to capture images of a plurality of cells, said plurality of cells sufficient in number to provide a morphological parameter value statistically equivalent to an average morphological parameter value calculated from a measurement of a morphological characteristic of each individual cell in the multitude of cells, said cells having been cut while the printing member is operating at equilibrium conditions;

transducing the optical images into electronic signals representative thereof;

using the electronic signals to analyze the morphological characteristics of the cells with the computer processor;

responsive to the analysis of the morphological characteristics of the cells and the predetermined morphological characteristic, adjusting the quality control characteristics of the printing member.

* * * * *